US011553795B2

(12) United States Patent
Avallon

(10) Patent No.: US 11,553,795 B2
(45) Date of Patent: Jan. 17, 2023

(54) SYSTEM, APPARATUS AND METHODS FOR A MOBILE PIVOTABLE DRY ERASE BOARD

(71) Applicant: ICP Construction, Inc., Andover, MA (US)

(72) Inventor: Jeff Avallon, Boston, MA (US)

(73) Assignee: ICP Construction, Inc., Andover, MA (US)

( * ) Notice: Subject to any disclaimer, the term of this patent is extended or adjusted under 35 U.S.C. 154(b) by 1193 days.

(21) Appl. No.: 16/006,636

(22) Filed: Jun. 12, 2018

(65) Prior Publication Data

US 2018/0352957 A1 Dec. 13, 2018

Related U.S. Application Data

(60) Provisional application No. 62/518,527, filed on Jun. 12, 2017.

(51) Int. Cl.

| | |
|---|---|
| ***A47B 97/04*** | (2006.01) |
| ***B43L 1/00*** | (2006.01) |
| ***A47B 85/06*** | (2006.01) |
| ***A47B 3/00*** | (2006.01) |

(52) U.S. Cl.

CPC ..... *A47B 97/04* (2013.01); *A47B 3/00* (2013.01); *A47B 85/06* (2013.01); *B43L 1/00* (2013.01)

(58) Field of Classification Search

CPC ..... A47B 85/06; A47B 97/04; B43L 1/04
USPC ..... 434/419; 108/11, 13
See application file for complete search history.

(56) References Cited

U.S. PATENT DOCUMENTS

| | | | | | |
|---|---|---|---|---|---|
| 284,251 | A * | 9/1883 | Smille | A47B 41/02 | 297/118 |
| 317,588 | A * | 5/1885 | Smith et al. | G09B 19/00 | 434/432 |
| 323,350 | A * | 7/1885 | McKenzie | B43L 1/04 | 434/413 |
| 339,741 | A * | 4/1886 | Clough | G09B 29/12 | 434/152 |
| 413,679 | A * | 10/1889 | Obergh | A47B 41/02 | 108/62 |
| 458,852 | A * | 9/1891 | Larew | B43L 1/04 | 434/413 |
| 493,134 | A * | 3/1893 | Utter | A47B 25/00 | 40/119 |
| 549,846 | A * | 11/1895 | Doll | A47B 41/02 | 273/287 |
| 553,184 | A * | 1/1896 | Burns | A47B 31/06 | 108/94 |
| 641,683 | A * | 1/1900 | Evans | A47B 41/02 | D19/114 |
| 643,731 | A * | 2/1900 | Prosser et al. | A47B 41/02 | 434/432 |

(Continued)

*Primary Examiner* — Jose V Chen
(74) *Attorney, Agent, or Firm* — Fredrikson & Byron, P.A.

(57) ABSTRACT

An apparatus for a mobile floor standing structure with a wheeled base, attached to a dry-erase board is described. The dry erase board can be secured to the stand at a vertical orientation to give rise to a vertically standing writable dry-erase board. Alternatively, the dry-erase board being pivotably oriented form a vertical position to a horizontal position to yield into a writable dry erase board in a table configuration. The wheeled base adds ease in maneuverability and portability of the apparatus.

8 Claims, 7 Drawing Sheets

(56) References Cited

U.S. PATENT DOCUMENTS

| | | | | | |
|---|---|---|---|---|---|
| 1,792,993 | A * | 2/1931 | Lochner | A47B 85/02 | 248/137 |
| 2,541,664 | A * | 2/1951 | Pollack | A47B 13/081 | 434/432 |
| 2,926,794 | A * | 3/1960 | Karoff | A47B 13/16 | 108/26 |
| 3,034,230 | A * | 5/1962 | Windram | A47B 97/08 | 434/408 |
| 3,107,442 | A * | 10/1963 | Levine | A47B 83/008 | D19/114 |
| 3,148,461 | A * | 9/1964 | Johnson | G09B 1/00 | 359/872 |
| 3,605,650 | A * | 9/1971 | Hebel et al. | A47B 85/02 | 108/62 |
| D273,828 | S * | 5/1984 | Oshry | D6/312 | |
| 6,113,182 | A * | 9/2000 | Wise | A47B 85/06 | 297/119 |
| 6,471,174 | B2 * | 10/2002 | Turner | A47B 97/04 | 248/446 |
| 9,615,678 | B1 * | 4/2017 | Lindblom | A47F 5/16 | |
| D897,432 | S * | 9/2020 | Florin | D19/114 | |
| 2015/0223600 | A1 * | 8/2015 | Pan | A47B 7/02 | 108/91 |
| 2018/0213928 | A1 * | 8/2018 | Kassanoff | A47B 13/02 | |

* cited by examiner

SYSTEM, APPARATUS AND METHODS FOR A MOBILE PIVOTABLE DRY ERASE BOARD

CROSS-REFERENCE TO RELATED APPLICATION

This application claims the benefit of U.S. Provisional Application No. 62/518,527, filed Jun. 12, 2017 and entitled as "System, Apparatus and Methods for a Mobile Pivotable Dry Erase Board", which is incorporated herein by reference in its entirety.

FIELD

The present invention is related to dry erase board systems in general and, more particularly, to a system configured to pivot and lock the dry erase board from a vertical to horizontal orientation and vice versa.

BACKGROUND

Prior art examples of combination black board and table described in U.S. Pat. No. 948,905 (Snyder), a combination blackboard and folding table described in U.S. Pat. No. 2,397,405 (Burkeman), a combined table and drawing easel described in U.S. Pat. No. 2,607,646 (West camp), a convertible table and easel described in U.S. Pat. No. 6,575,103 (Holdredge) and a folding table described in U.S. Pat. No. 7,634,968 (Cornelius). The disadvantages associated with most prior art combination table is the complicated and expensive construction or assembly and the swivel mechanism being mechanically susceptible and therefore not representing a robust operational system.

Accordingly, there is a need for a portable, mobile, floor standing structure capable of being attached to a dry-erase board and being capable of pivoting the dry-erase board from a vertical position to a horizontal position to be used as a dry-erase board table in a convenient manner.

SUMMARY

This disclosure relates to a mobile floor standing stand attached to a single or dual sided dry-erase board, which includes two pairs of leg stands attached to a pair of stretchers and to a wheeled base for mobility purposes.

In an embodiment, a mobile, pivotable, floor standing structure supporting a dry-erase writable board having a frame with a length side and a breadth side, a pair of leg stands disposed adjacently and outwardly at the middle of each length side of the rectangular dry erase board frame, a pair of top brackets welded to an upper portion of leg stands and fastened to each length side of rectangular dry-erase board frame with first set of locating pins, a mounting bracket, the mounting bracket that is attached to each length side of the dry-erase board on one side and to the top bracket on the other side, the top bracket further having a pivot for a mounting bracket attached to the dry-erase board frame from a vertical position to a horizontal position and each of a leg of the leg stands secured with feet caps and attached to castor wheels for mobility.

The floor standing console as disclosed provides a number of advantages, including different tilt positions, ranging from a vertical position to a horizontal position. Since the stand can be maneuvered around any flat floor, there is no need for installing fixtures to fix on to a wall. The stand portion and the dry-erase portion can be used to hang on caddies to store writing and erasing instruments conveniently.

It should be understood that the summary above is provided to introduce in simplified form a selection of examples that are further described in the detailed description. It is not meant to identify key or essential features of any claimed subject matter that may later claim priority to the present description. Furthermore, the scope of any such claimed subject matter would not be limited to implementations that solve any disadvantages noted above or contained herein.

BRIEF DESCRIPTION OF THE DRAWINGS

Many aspects of the present invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The embodiments in this disclosure, as illustrated in FIGS. 1 through 7 below illustrate an improved dry erase board system.

Figure 1:
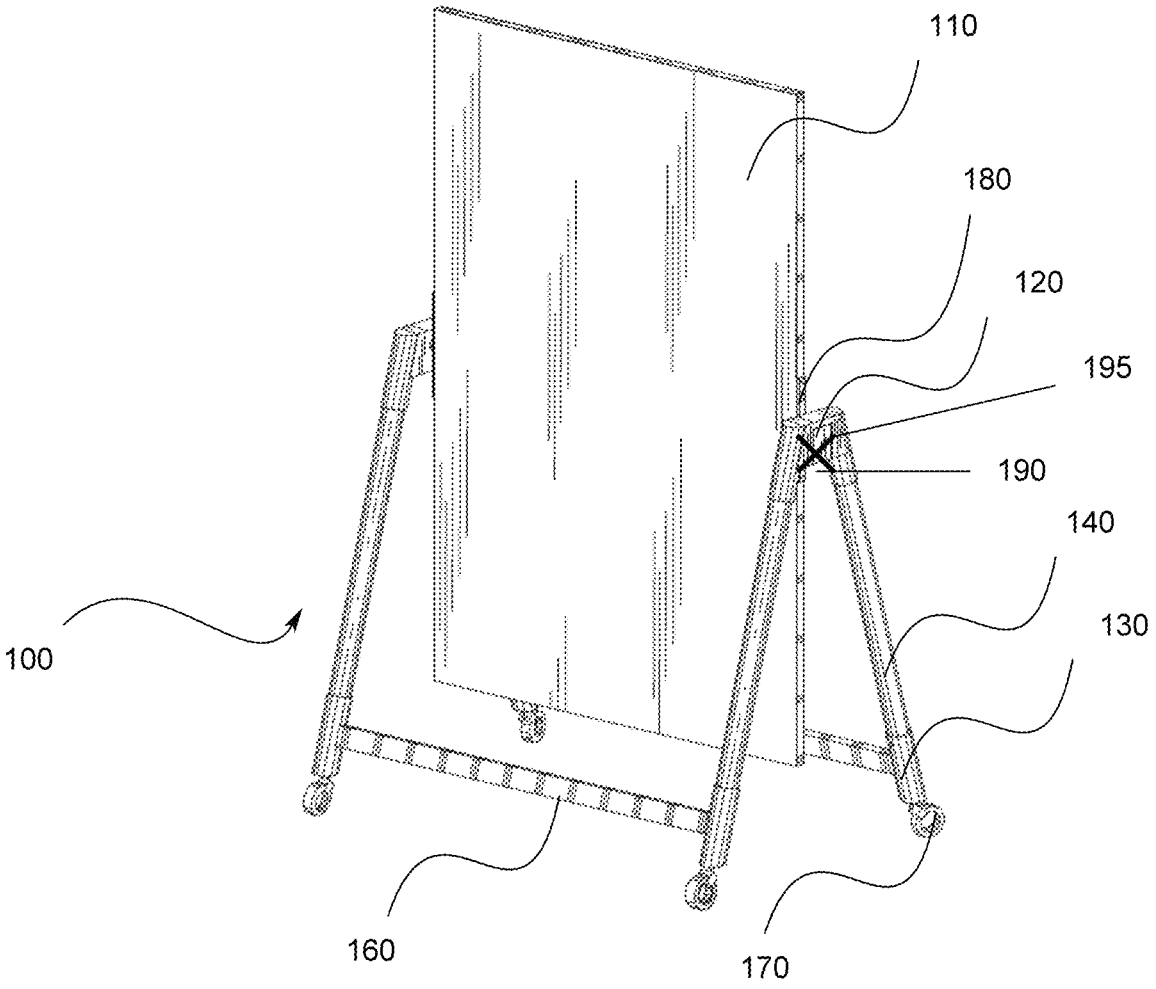
FIG. 1 illustrates a perspective view of a pivot dry-erase board in vertical configuration.

In an embodiment, referring to FIG. 1, 100 is a perspective view of pivot dry-erase mobile board in a vertical configuration. The dry-erase board 110 is held in a vertical position by a top bracket weldment 120 and bottom stretcher weldment 130 attached to a pair of leg stands 140 and stretchers 160 on both length sides of the dry erase board 110. The bottom stretcher weldment is attached to a wheeled base of castor wheels 170. The top bracket weldment 120 is fastened to the mounting plate 180 at the mid-section 190 of the dry-erase board 110 with locating pins (not shown). A pivot handle 195 offers comfortable grip for bringing about a pivoting motion to change the orientation of the dry erase board.

Figure 2:
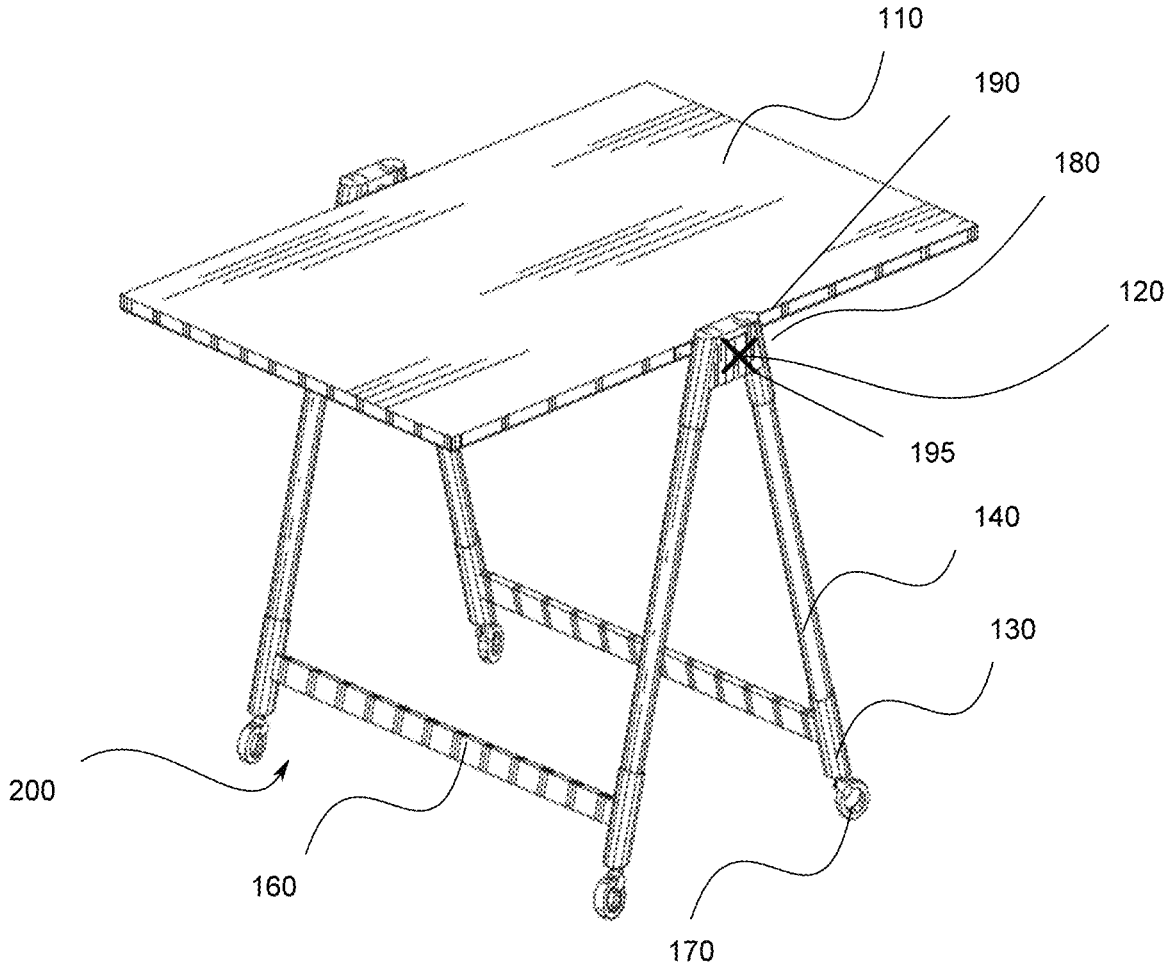
FIG. 2 illustrates a perspective view of a pivot dry-erase board in horizontal configuration.

Referring to FIG. 2, 200 is a perspective view of pivot dry-erase mobile board in a horizontal configuration or also known as the table configuration. The dry-erase board 110 is held in a horizontal position by a top bracket weldment 120 and bottom stretcher weldment 130 attached to a pair of leg stands 140 and stretchers 160 on both length sides of the dry erase board 110. The bottom stretcher weldment is attached to a wheeled base of castor wheels 170. The top bracket weldment 120 is fastened to the mounting plate 180 at the mid-section 190 of the dry-erase board 110 with locating pins (not shown). A handle 195 offers comfortable grip for bringing about a pivoting motion to change the orientation of the dry erase board.

Figure 3:
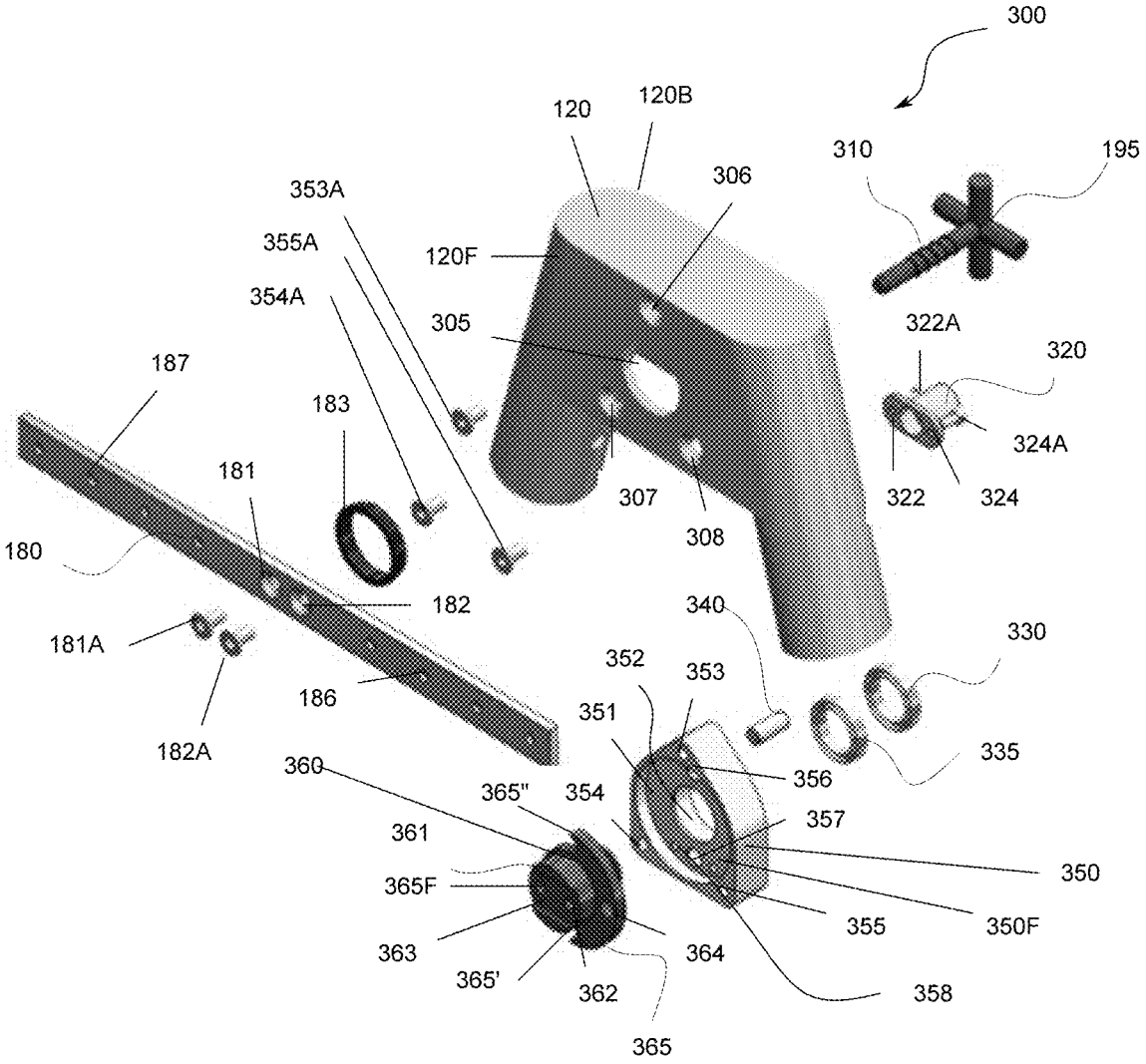
FIG. 3 illustrates an exploded view of the components of a pivoting mechanism.

In an embodiment, as illustrated in FIG. 3, a system 300 describes the components included in a pivoting mechanism for pivoting the dry erase board 110 from a vertical position to a horizontal position and vice-versa. The top bracket weldment 120 with a forward face 120F and a backward face 120B, hosts the components of the pivoting mechanism in an annular opening 305 surrounded by three screw holes 306, 307 and 308.

A cylindrical cam 360 with a semi-circular ring flange 365 with two terminal concave pockets 365' and 365" is received in a forward face 350F of a cam housing 350. The cylindrical cam 360 hosts two screw holes 361 and 362 arranged in a linear fashion in a rectangular recessed portion 363 and the semicircular flange hosts a screw hole 364 collinear with the screw holes 361 and 362.

The cam housing 350 further includes a first annular recessed spacing 351 with a first diameter D', which is concentric with a second annular opening 352 with a second diameter D". The first diameter D' selected to aptly engage the semicircular flange 365 of the cylindrical cam 360 and the second diameter selected to aptly engage the cylindrical cam 360. The outer edge of the cam housing 350 equipped with three screw holes 353, 534 and 355, the first annular recessed spacing 351 hosts two screw holes in a vertical orientation 356, 357 and a pair of screw holes 358 in a horizontal orientation.

The combination of cam 360 with its semicircular flange 365 and the cam housing 350 is securely received in the annular opening 305 at the back-ward face 120B of the top bracket weldment 120 by inserting the top bracket weldment screws 353A, 354A and 355A through the coaxially aligned screw holes of the top-bracket weldment 306, 307 and 308 and the cam housing screw holes 353, 354 and 355 respectively.

A backward face 350B of the cam housing 350 is fitted with a stopping pin 340, a primary washer 330 and a secondary washer 335. A tee nut with an elliptical base 320 with screw holes 322 and 324 is fitted on to the pair of screw holes in the horizontal orientation 358 with tee nut screws 322A and 324A. Further a threaded handle 195 with threading 310 is received in the tee-nut 320. The handle 195 is turned in and out conveniently through a cylindrical pathway through the tee nut 320.

The mounting bracket 180 is connected to the cylindrical cam 360 by aligning the two screw holes 361 and 362 of the rectangular recessed portion 363 of the cylindrical cam 360 and the screw holes 181 and 182 of the mounting bracket via a washer 183 and mounting bracket screws 181A and 182A. The set of screw holes 186 and 187 on either side of the mounting bracket screw holes 181 and 182 assist in attaching a length side of the dry erase board 110.

In other embodiments the pivoting mechanism for pivoting the dry erase board from a vertical position to a horizontal position and vice-versa may be included in at least one of the top bracket weldment 120 or may be included in both the top bracket weldment 120 on either side of the dry erase board.

Figure 4:
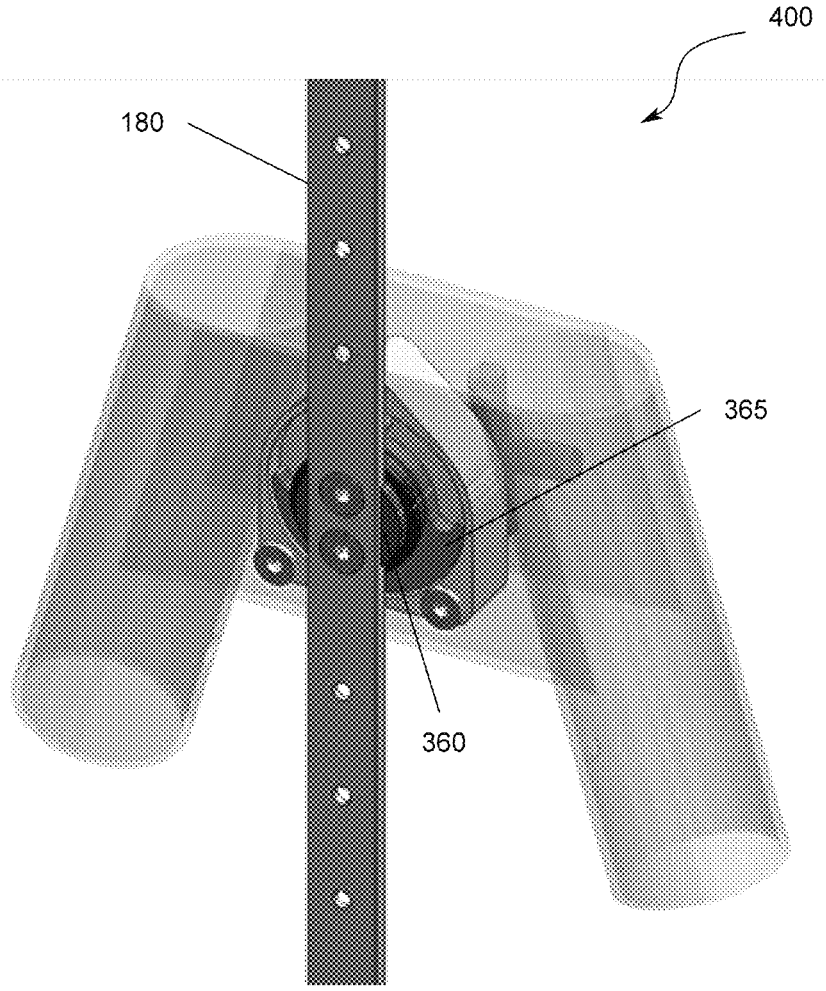
FIG. 4 illustrates the lock position of the mounting bracket in a vertical position.

Referring to FIG. 4, the mounting bracket 180 is illustrated in its vertical configuration 400 and it can be seen that the cam 360 is locked in the vertical position for the mounting bracket 180 by the engagement of the threaded handle via the aligned screw holes 357 of the cam housing and the screw hole 364 of the semicircular flange 365 of the cylindrical cam 360.

Figure 5:
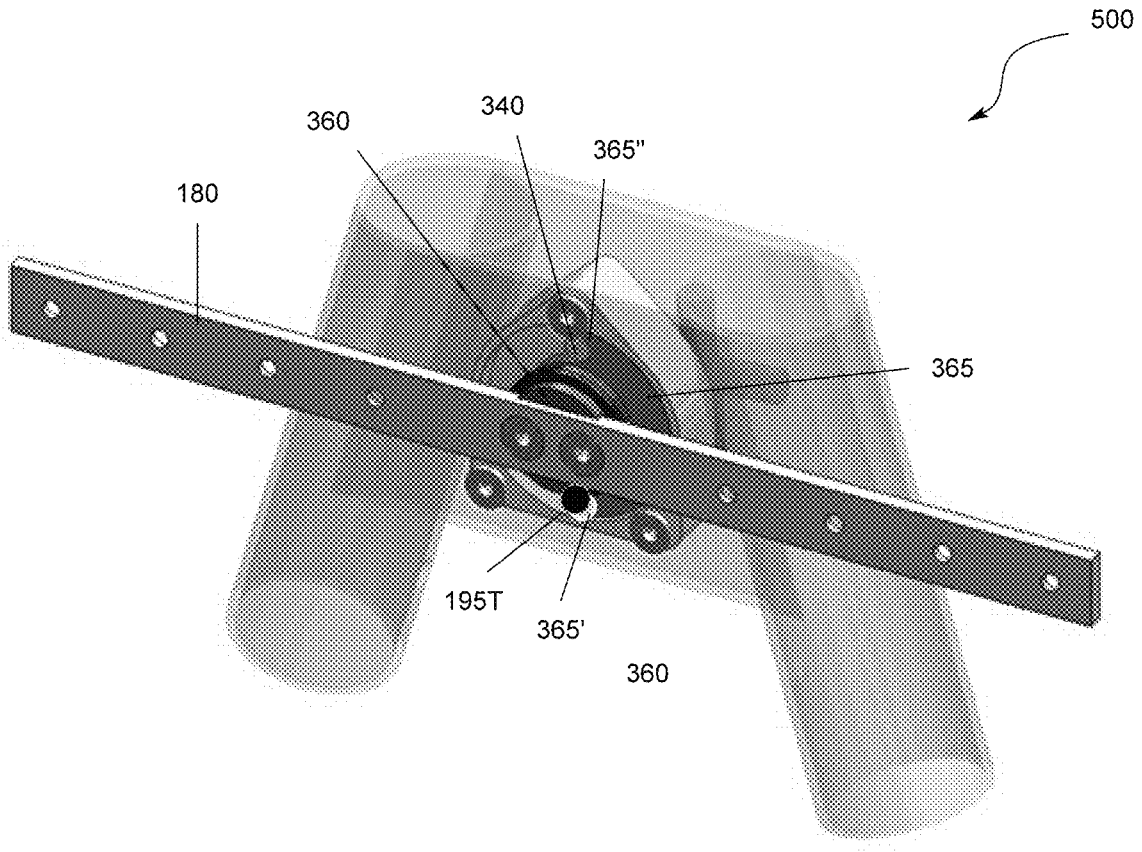
FIG. 5 illustrates the lock position of the mounting bracket in a horizontal position.

Referring to FIG. 5, the mounting bracket is illustrated in its horizontal configuration 500 and it can be seen that the cam 360 is locked in the horizontal position for the mounting bracket by the engagement of the threaded handle via the aligned screw holes 357 of the cam housing and the tip of the threaded handle 195T acting as a lock pin for the bottom concave pocket 365' and the stopping pin 340 acts as a lock pin for the top concave pocket 365" of the semicircular flange 365 of the cylindrical cam 360.

Figure 6:
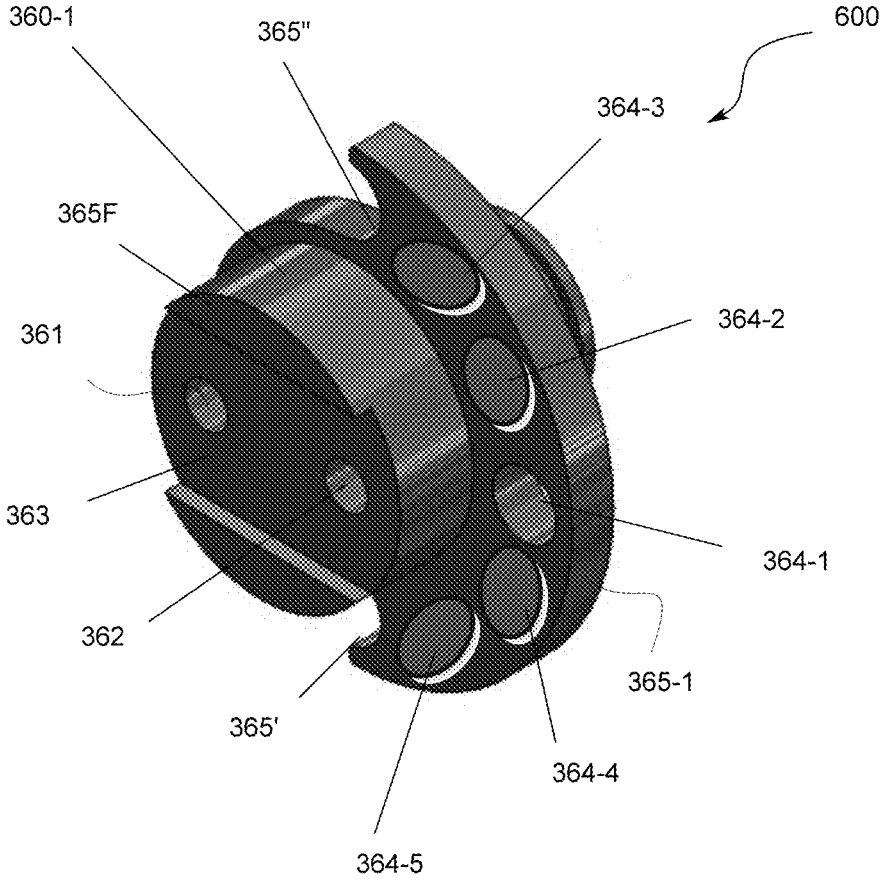
FIG. 6 illustrates an alternate cylindrical cam with its semi-circular flange having multiple screw holes.

Referring to FIG. 6, an alternate structure 600 for a cam 360-1 is described. The cylindrical cam 360-1 is equipped with its semicircular flange 365-1 including additional screw holes on both sides of the central screw hole 364-1, namely 364-2 to 364-5. When the top bracket weldment 120 includes a cam 360-1 as part of the pivoting components 300 described above, on both length sides of the dry erase board 110, the pivoting mechanism can provide additional tilt angles for an attached mounting bracket 180 and thus for a dry erase board 110 orientation. The dry erase board 110 can be tilted to any desired tilt angle and the pivot handle 190 can be turned in into any of the semicircular flange screw holes 364-1 to 364-5 via the screw holes 357 of the cam housing, on both sides of the dry erase board 110 and lock the dry erase board in any desired tilt angle.

Figure 7:
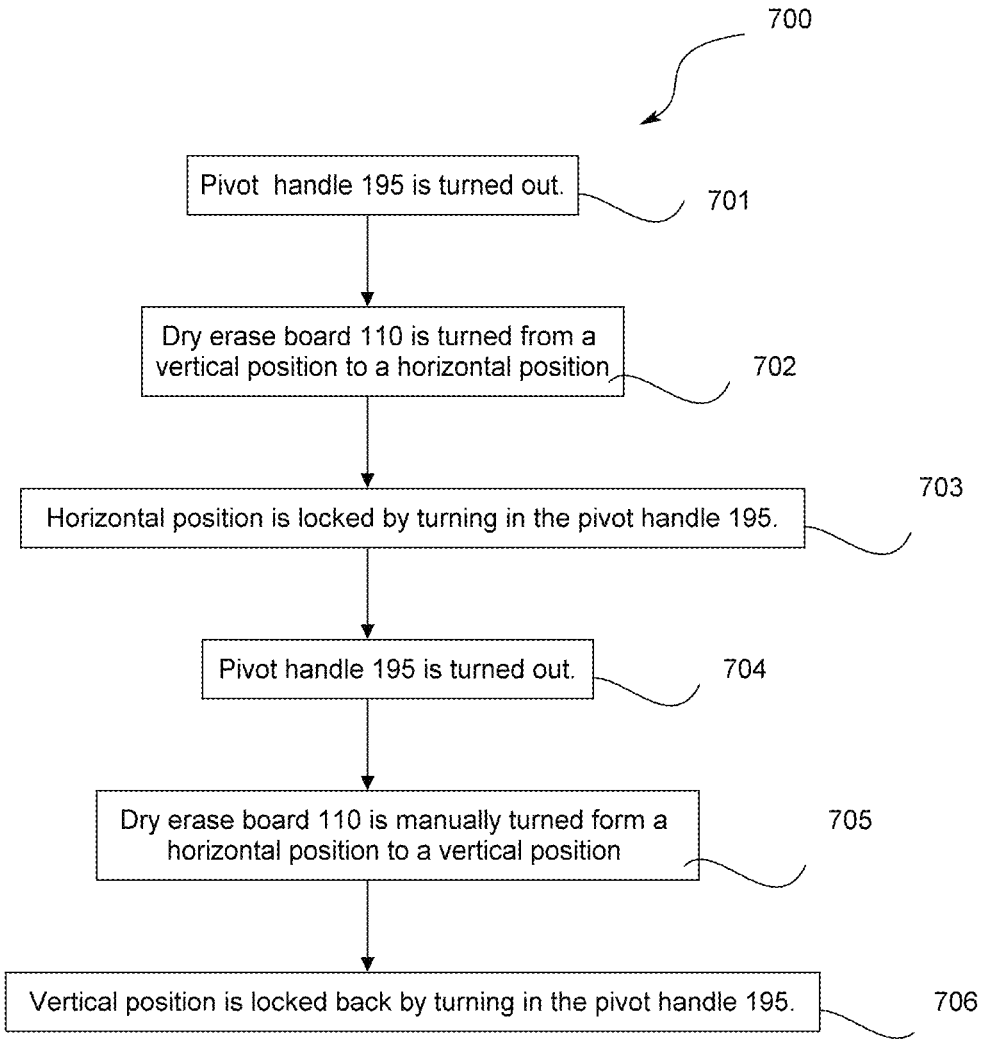
FIG. 7 illustrates a sequence for method steps for pivoting a dry erase board.

Referring to FIG. 7, the method steps 700 involved in pivoting a dry erase board from a vertical position to a horizontal position and then pivoting back to the vertical position is described. Initially the pivot handle 195 is turned out—step-1-701, then the dry erase board 110 is manually turned from a vertical position to a horizontal position—step-2-702 and the horizontal position is locked by turning in the pivot handle 195—step-3-703. To bring the dry erase board 110 back to a vertical position, the pivot handle 195 is turned out—step-4-704, then the dry erase board is manually turned form a horizontal position to a vertical position—step-5-705 and the vertical position is locked back by turning in the pivot handle 195—step-6-706.

As the user turns in the handle 195 in a clock wise direction the connected cylindrical cam 360 with its semicircular flange 365 moves from its first position to a second position traversing a semicircular path and in turn turning the mounting bracket 180 and the attached dry erase board 110 from a vertical position to a horizontal position. As the user turns back the handle 195 in a anti clock wise direction the connected semicircular flange moves from its second position back to its first position traversing back the semicircular path and in turn turning the dry erase board from a horizontal position to a vertical position. The stopping pin 340 and the pivot handle 195 help in blocking further motion of the cylindrical cam in either clockwise or anti-clockwise directions, thus locking the desired orientation of the dry erase board 110.

In other embodiments, a pivoting switch that translates a rotational movement of a portion of the pivoting switch into a linear movement for toggling a button may be used. The pivoting switch can include a pin that extends into the mounting plate 508 in order to define and limit a rotational movement of the pivoting switch. The pivoting switch can further include a switch cavity that can force a knob of the button to move with the pivoting switch. The embodiments can further include an electrical switch having a welded cover plate. The welded cover plate can include arms that extend across and are welded to one or more boards of the electrical switch. The welded cover plate provides a more secure retaining mechanism for the electrical switch in order to reduce bending of certain portions of the electrical switch when the electrical switch is toggled.

In an exemplary embodiment, a typical pivot dry erase board would have an overall vertical length ranging between 63.0 to 65.0 inches and the horizontal breadth ranging between 40.0 to 43.0 inches, supported by a stand of length ranging between 45.0 to 47.0 inches.

It can be appreciated by a person of skill in the art that the dry-erase board may include steel coated board with white paint powder or could be made of magnetic material or could be a baltic birch plywood coated with clear paint.

A mobile, pivotable, floor standing structure supporting a writable board, including a dry-erase board frame a having a length side and a breadth side, a pair of leg stands disposed adjacently and outwardly at the middle of each length side of the rectangular dry erase board frame, a pair of top bracket welded to an upper portion of leg stands and fastened to each length side of rectangular dry-erase board frame with first set of locating pins; a mounting bracket, the mounting bracket attaching to each length side of the dry-erase board on one side and to the top bracket on the other side, the top bracket further comprising of pivot mechanism for pivoting the mounting bracket attached to the dry-erase board frame from a vertical position to a horizontal position and each of a leg of the leg stands secured with feet caps and attached to castor wheels for mobility. The dry erase board frame has dual writable board. The dry erase board frame has framework selected from a group of rectangular, square, circular or oval shapes. The dry-erase board consists of steel coated board with white paint powder. Wherein the dry-erase board can be magnetic. The dry-erase board consists of baltic birch plywood coated with clear paint. The pivot mechanism is capable of tilting the dry erase board at several intermediate positions between the vertical and horizontal position. The pivot mechanism is based on an electrical switch mechanism.

It should be appreciated by those of ordinary skill that the specific structural and material configurations of the dry-erase boards are described herein for exemplary purposes. The instant invention may be embodied in other forms or carried out in other ways without departing from the spirit or essential characteristics thereof. The present disclosure is therefore to be considered as in all respects illustrative and not restrictive, the scope of the invention being indicated by the appended claims, and all equivalency are intended to be embraced therein.

One of ordinary skill in the art would be able to recognize equivalent embodiments of the instant invention and be able to practice such embodiments using the teaching of the instant disclosure and only routine experimentation.

What is claimed is:

1. A system for a mobile, pivotable, floor standing dry erase board, comprising:

a dry-erase board frame having a length side and a breadth side;

a pair of leg stands disposed adjacently and outwardly at the middle of each length side of the dry-erase board frame;

a pair of top bracket welded to an upper portion of the pair of leg stands and fastened to each length side of the dry-erase board frame with a first set of locating pins;

a mounting bracket, the mounting bracket attached to each length side of the dry-erase board frame on one side and to the top bracket on the other side;

at least one of the top bracket further comprising of pivoting subsystem for pivoting the mounting bracket attached to the dry-erase board frame from a vertical position to a horizontal position, the pivoting subsystem comprising a cylindrical cam with a semicircular flange securely received in a cam housing, wherein a circular motion of the semicircular flange in the cam housing controlled by a stopping pin and a pivot handle; and each of a leg of the pair of leg stands being attached to castor wheels for mobility.

2. The system as described in claim 1, wherein the dry-erase board frame has dual writable surfaces.

3. The system as described in claim 1, wherein the dry-erase board frame has a framework selected from a group of rectangular, square, circular, or oval shapes.

4. The system as described in claim 1, wherein the dry-erase board comprises a steel coated board with white paint powder.

5. The system as described in claim 1, wherein the dry-erase board is magnetic.

6. The system as described in claim 1, wherein the dry-erase board comprises a birch plywood coated with clear paint.

7. The system as described in claim 1, wherein the pivoting subsystem is capable of tilting the dry-erase board frame at one or more intermediate positions between the vertical position and the horizontal position.

8. The system as described in claim 1, wherein the pivoting subsystem is configured to be electrically controlled.

* * * * *